US008530805B2

(12) United States Patent
Boer et al.

(10) Patent No.: US 8,530,805 B2
(45) Date of Patent: Sep. 10, 2013

(54) METHOD FOR CONTROLLING AN INDUCTION HEATING SYSTEM OF A COOKING APPLIANCE

(75) Inventors: Alessandro Boer, Biandronno (IT); Francesco Del Bello, Rome (IT); Diego Neftali Gutierrez, Varese (IT); Jurij Paderno, Varedo (IT); Davide Parachini, Cassano Magnago (IT); Gianpiero Santacatterina, Sangiano (IT)

(73) Assignee: Whirlpool Corporation, Benton Harbor, MI (US)

( * ) Notice: Subject to any disclaimer, the term of this patent is extended or adjusted under 35 U.S.C. 154(b) by 769 days.

(21) Appl. No.: 12/628,461

(22) Filed: Dec. 1, 2009

(65) Prior Publication Data

US 2010/0133260 A1 Jun. 3, 2010

(30) Foreign Application Priority Data

Dec. 2, 2008 (EP) ..... 08170515

(51) Int. Cl.
*H05B 6/08* (2006.01)
*H05B 6/12* (2006.01)

(52) U.S. Cl.
USPC ..... 219/626; 219/620; 219/621

(58) Field of Classification Search
USPC ..... 219/620–627
See application file for complete search history.

(56) References Cited

U.S. PATENT DOCUMENTS 4,210,827 A * 7/1980 Kanazawa et al. ..... 327/306

FOREIGN PATENT DOCUMENTS

| | | | |
|---|---|---|---|
| AT | 389969 | B | 2/1990 |
| EP | 0427879 | A1 | 5/1991 |
| EP | 1420613 | A2 | 5/2004 |
| EP | 1420613 | A2 | 5/2005 |
| EP | 1732357 | A2 | 12/2006 |
| EP | 1898063 | A1 | 3/2008 |
| EP | 1732357 | A2 | 12/2008 |
| GB | 2062985 | A | 5/1981 |
| JP | 11126681 | A * | 5/1999 |

OTHER PUBLICATIONS

European Application No. EP08170515.4, filed Dec. 12, 2008, Applicant: Whirlpool Corporation and Teka Industrial SA. European Publication No. 2194755A1, published Jun. 9, 2010.

* cited by examiner

*Primary Examiner* — Matthew W Such
*Assistant Examiner* — Robert Carpenter

(57) ABSTRACT

A method for controlling an induction heating system of a cooking appliance provided with an induction coil, particularly for controlling it in connection with a predetermined working condition, comprises measuring the value of one electrical parameter of the induction heating system, feeding a computing model with actual switching frequency signals in order to estimate a temperature indicative of the thermal status of the heating system and to provide an estimated value of the electrical parameter, and comparing the measured electrical parameter with the estimated one and tuning the computing model on the basis of such comparison.

8 Claims, 4 Drawing Sheets

METHOD FOR CONTROLLING AN INDUCTION HEATING SYSTEM OF A COOKING APPLIANCE

BACKGROUND OF THE INVENTION

1. Field of the Invention

The present invention relates to a method for controlling an induction heating system of a cooktop provided with an induction coil, particularly for controlling it in connection with a predetermined working condition.

More specifically the invention relates to a method to estimate the temperature of a cooking utensil placed on the cooktop and the temperature of the food contained therein, as well as the food mass.

2. Description of the Related Art

With the term "heating system" we mean not only the induction coil, the driving circuit thereof and the glass ceramic plate or the like on which the cooking utensil is placed, but also the cooking utensil itself, the food content thereof and any element of the system. As a matter of fact in the induction heating systems it is almost impossible to make a distinction between the heating element, on one side, and the cooking utensil, on the other side, since the cooking utensil itself is an active part of the heating process.

The increasing need of cooktops performances in food preparation is reflected in the way technology is changing in order to meet customer's requirements. Technical solutions related to the evaluation of the cooking utensil or "pot" temperature derivative are known from EP-A-1732357 and EP-A-1420613, but none discloses a quantitative estimation of the pot temperature.

Information is available in scientific literature about algorithms concerning state estimation (Recursive Least Square, Kalman Filter, Extended Kalman Filter [EKF] etc.); none of them relates to an industrial application focused on induction cooking appliances.

SUMMARY OF THE INVENTION

It is an object of the present invention to provide a method according to which a temperature value connected to the temperature of the pot and/or of the food contained therein or of the induction heating system or of the glass surface placed under the pot can be assessed in a reliable way, particularly with reference to a heating condition in which the temperature of the food has to be kept substantially constant (boiling condition, simmering or the like).

According to the invention, the above object is reached thanks to the features listed in the appended claims.

The control method according to the present invention is used for estimating the temperature of a pot, pan or a griddle (in the following indicated simply as "pot"), used onto the induction cooktop, food thermodynamics state inside the pot (mass and temperature/enthalpy/entropy/internal energy, etc.) and induction coil temperature by the knowledge of the switching frequency of the induction heating system and of at least another measured electrical parameter of the induction heating system.

In general, the estimation reliability (roughly such reliability could be assumed a function of the difference between the actual value and the estimated value) gets better and better as the number of available electrical measurements increases. Moreover, the estimation reliability gets better and better as the number of switching frequencies at which the electrical measurement(s) is acquired increases.

According to the invention, no constrain is imposed on the way the switching frequency(-ies), at which the electrical measurement(s) is acquired, is chosen. The estimated pot temperature can be used e.g. to monitor or control the temperature. The estimated food temperature can be used e.g. to monitor or control the temperature or the cooking phase (as boil detection, boil control, in case the 'food' is 'water' or similar kind of liquids). The estimated food mass can be used e.g. to monitor or control the cooking phase. The estimated coil temperature can be used e.g. to prevent damages due to overheating. The parameters of a simplified equivalent electrical circuit that describes the behaviour of the process are useful to estimate the temperature of the pot, to detect a dynamic mismatching, and the pot quality as well.

Another aspect of the present invention is to provide a method that non only allow to evaluate the temperature of the pot or of the food contained wherein (and eventually its mass), but also that is able to compensate different noise factors. Some noise factors that can affect the estimation are for example the initial pot/food temperature and initial food mass, the voltage fluctuation of the electrical network, the tolerances/drift of the components, the use of different pots and the possible movements of the pot away from its original position.

BRIEF DESCRIPTION OF THE DRAWINGS

Further features and advantages according to the present invention will become clear from the following detailed description with reference to the annexed drawings in which.

DETAILED DESCRIPTION OF THE PREFERRED EMBODIMENTS

Figure 1:
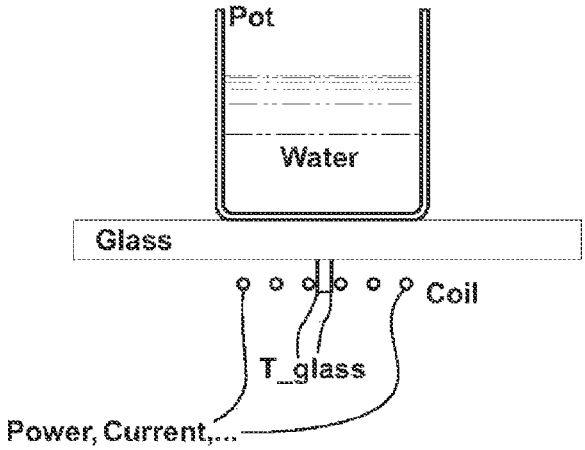
FIG. 1 is a schematic view of an induction cooktop.
Figure 2:
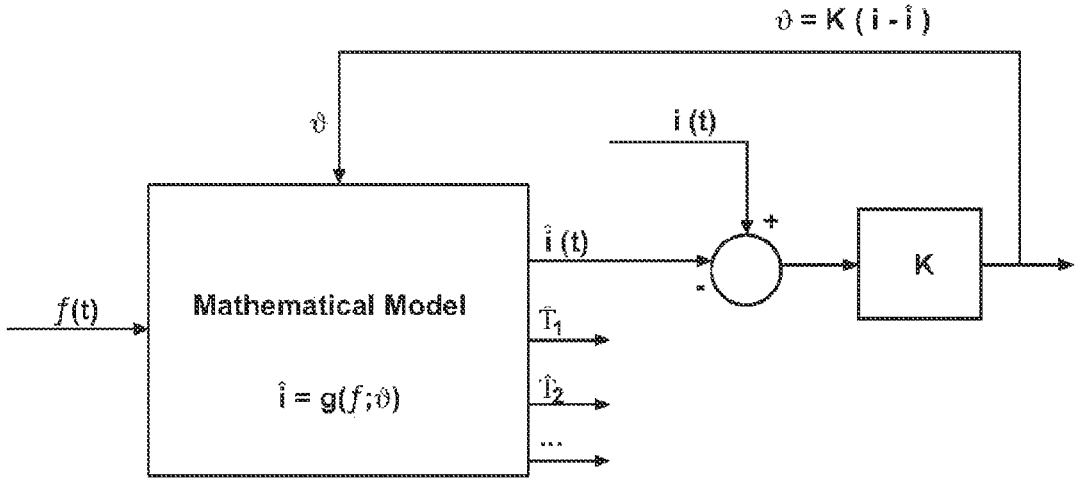
FIG. 2 is a sketch showing how the model according the invention works.

With reference to FIG. 2, the method comprises one (or more) electrical measurement of an electrical parameter, a mathematical model that provides at least an estimation of the electrical measurement(s) and one or more temperatures as a function of the switching frequency, and any kind of algorithm that tunes on-line the mathematical model in function of the difference between estimated and measured electrical parametes.

The on-line tuning of the model represents a way to compensate:

- the initial state uncertainty—i.e. if the model is based on differential equations, the initial state of the solution is required but it could be unknown;
- measurement errors—measurements are usually affected by noises;

model uncertainties—i.e. each model is a simplified representation of the reality and so it is always affected by "model uncertainties".

The ability to compensate the above uncertainties and errors comes from a model based approach that combines the model and the tuning thereof by a feedback on the difference between prediction end measures. Many algorithms are available in literature to fix these kinds of problems (Recursive Least Square, Kalman Filter, Extended Kalman Filter [EKF]) and therefore no detailed description of these is deemed necessary here.

As the effect of the temperature of the pot is usually appreciable only on a small subset of the model parameters, the on-line tuning of the algorithm can be split up in two steps. In the first step part of the model parameters (eventually all or none of them) are tuned on the basis of a first set of data; in the second step only the subset of model parameters that are affected by temperature variations are tuned on the basis of the data collected during the cooking phase.

To improve the performances of this method, the first step of the on-line tuning can be repeated during the cooking process whenever a modification on the process is detected (e.g. when a pot mismatching is detected), so giving the opportunity to compensate detectable noises.

As a consequence of the approach described above, a possible implementation of the method according to the invention is as follows.

Figure 3:
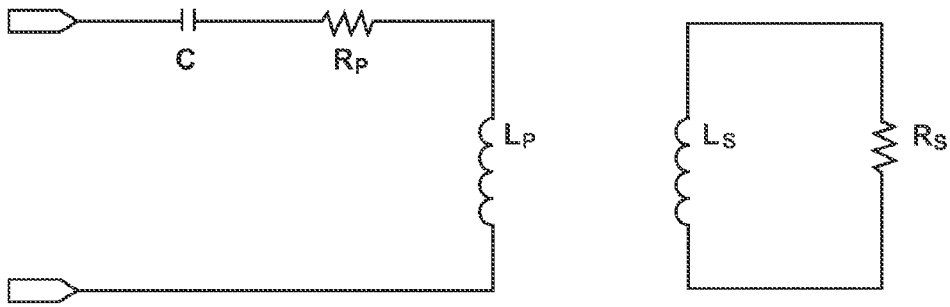
FIG. 3 is a schematic view of an electric circuit of one possible equivalent models.

EXAMPLE the current circulating in the induction coil (i) is measured;

the simplified mathematical model described by the following differential equations (Eq. 1) and shown in FIG. 3 is used:

in order to complete the method proposed in this example, the Extended Kalman Filter is used as on-line tuning algorithm.

The model proposed in this example is described by the following differential equations (Eq. 1), in which the suffix "p" stands for the primary circuit (i.e. the induction coil, and the capacitors) and the suffix "s" stands for the secondary circuit (i.e. the metal pot). These equations are an example of the relation between the input voltage, the current in the primary circuit and the current in the secondary circuit:

$$\begin{cases} L_P\frac{di_p}{dt} + M\frac{di_s}{dt} + R_P i_p + \frac{1}{C}\int i_p(\tau)d\tau = V_{IN}(t, f) \\ M\frac{di_p}{dt} + L_s\frac{di_s}{dt} + R_s i_s = 0 \\ R_s = R_0(1 + \alpha(T_{pot} - T_0) \end{cases} \quad \text{(Eq. 1)}$$

where:

$C \rightarrow$ equivalent capacitance of the primary circuit;

$R_p \rightarrow$ equivalent resistance of the primary circuit;

$L_p \rightarrow$ equivalent self-inductance of the primary circuit;

$L_s \rightarrow$ equivalent self-inductance of the secondary circuit;

$M \rightarrow$ equivalent mutual inductance;

$R_s \rightarrow$ equivalent resistance of the secondary circuit;

$V_{in} \rightarrow$ input voltage of the primary circuit;

$i_p \rightarrow$ current circulating in the primary circuit;

$i_s \rightarrow$ current circulating in the secondary circuit;

$R_0 \rightarrow$ equivalent resistance of the primary circuit when $T_{pot}=T_0$;

$T_{pot} \rightarrow$ Temperature of the pot bottom $T_0 \rightarrow$ Reference temperature $\alpha \rightarrow$ Adimensional parameter The model provides an estimation of different electrical variables of interest (in this case $i_p$, $i_s$), at least one of which must be measurable ($i_p$), and the estimation of the temperature of the pot ($\hat{T}_{pot}$) and uses the switching frequency f. For the on-line estimation of the model parameters it is possible to take advantage of the measures that are usually available on the appliance. For sake of simplicity, in the rest of the description of the invention it will be assumed to have the measure of the root mean square of the current circulating in the coil ($i_p$); however, an analogous process can be used having different electrical measures or different measurement points.

Figure 4:
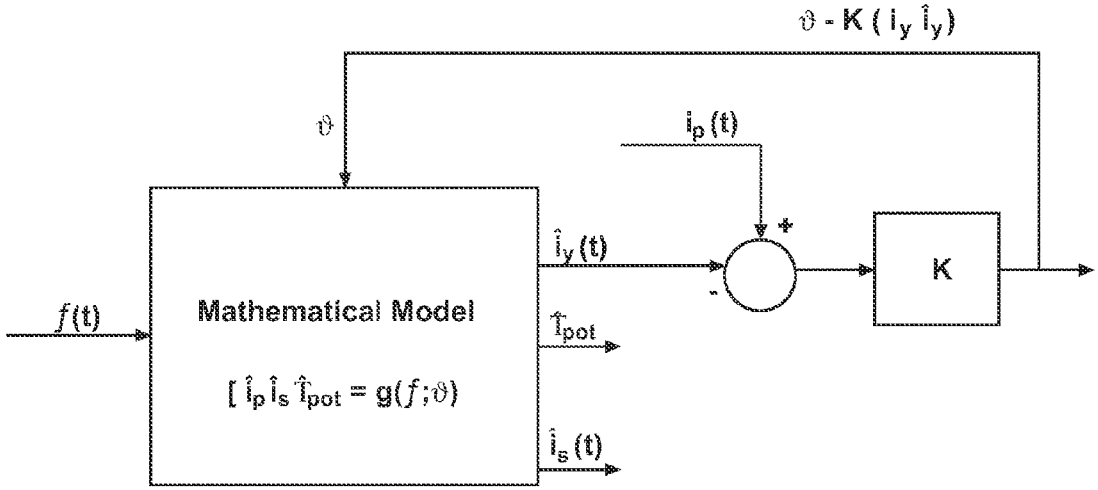
FIG. 4 shows one of the possible implementation of the method according to the invention.

As a result, the general sketch shown in FIG. 2 can be modified as in FIG. 4, where the element "K" represents the Kalman Matrix.

In this model the temperature of the pot is affecting only the $R_s$ parameter; hence the on-line tuning of the algorithm in this case can be split up in two steps:

part of the model parameters—C , $R_p$, $L_p$, $L_s$, M and $R_s$—(eventually all or none of them) are tuned on the basis of a first set of data;

only the subset of model parameters that are affected by temperature variations—$R_s$—is tuned on the basis of the data collected during the cooking phase.

Theoretically, the parameters C, $R_p$ and $L_p$ should be known by the manufacturer but the tolerances/drift of the components and the model imprecision require usually an on-line estimation of these parameters together with M , $L_s$ and $R_s$. However, if the resulting error is tolerated, one could skip the first part of the on-line tuning assuming that all the parameters are known.

In the present example, in the former step of the on-line tuning all of the model parameters have been optimized by using a line search algorithm on the basis of six acquisition of $i_p$ at six different frequencies. In the second step of the on-line tuning the $R_s$ parameter has been tuned with a Kalman filter using the current $i_p$ acquired at a known frequency that can eventually change during the cooking process.

Figure 5:
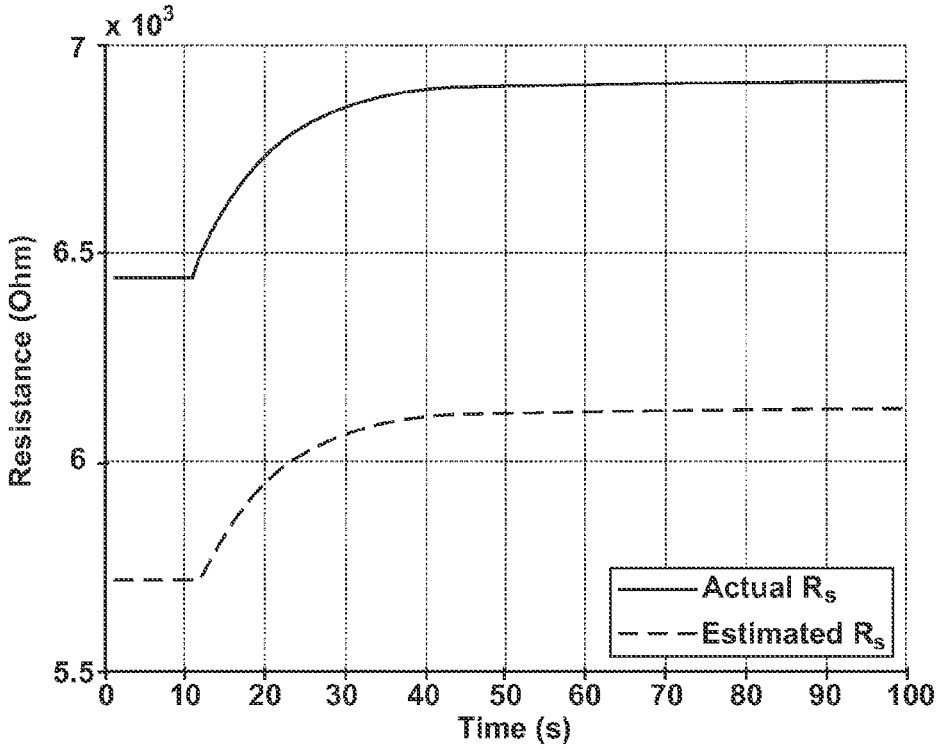
FIG. 5 shows a diagram comparing the actual and the estimated values of the equivalent resistance of the primary circuit.
Figure 6:
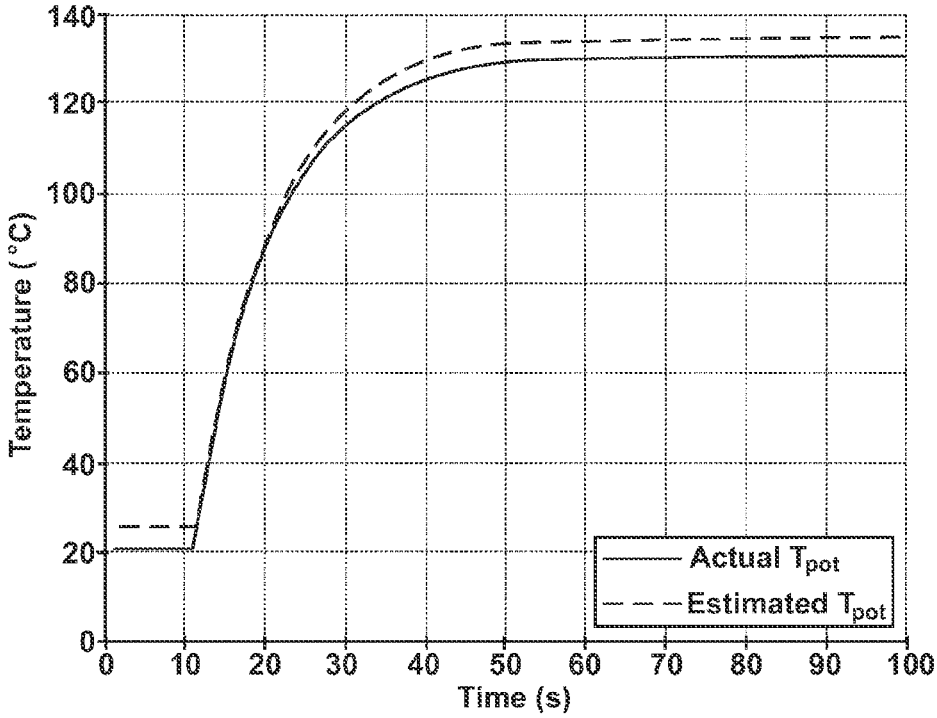
FIG. 6 is a figure similar to FIG. 5 and relates to a comparison between the actual and the estimated temperature values of the pot.

Even though the optimized parameters are different from the actual ones (cfr. FIG. 5), as can be seen in FIG. 6 the temperature of the pot is correctly estimated. In this particular case, the model is not able to compensate the initial state temperature error but the use of a more sophisticated model that takes into account also the thermal dynamics of the food can do this type of compensation.

Figure 7:
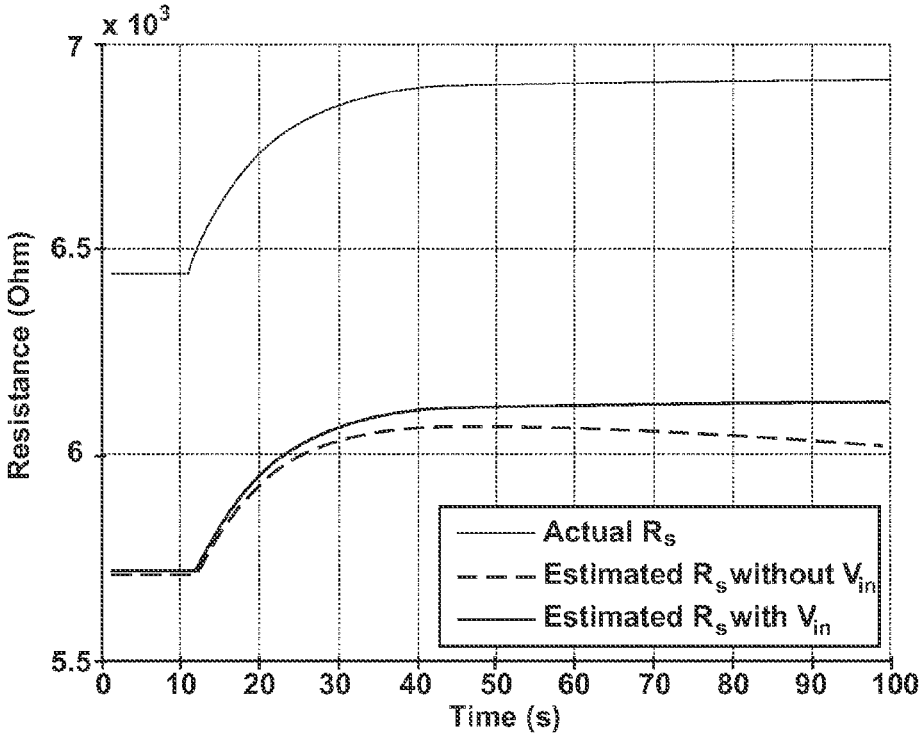
FIG. 7 is similar to FIG. 5 and shows the comparison with and without voltage compensation.
Figure 8:
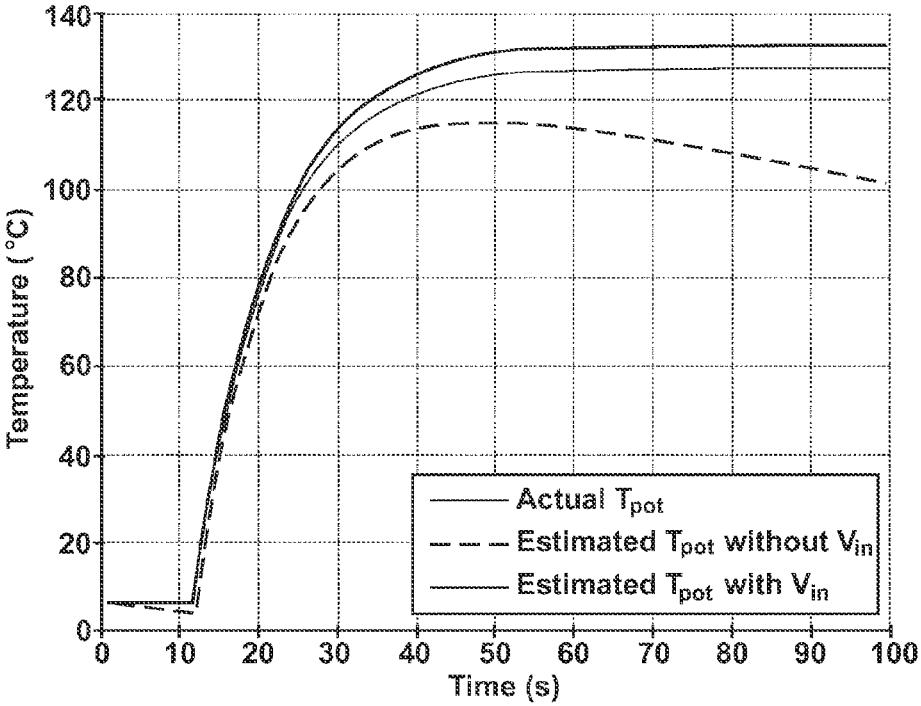
FIG. 8 is similar to FIG. 6 and shows the comparison with and without voltage compensation.

The results of the previous example can be improved by introducing the voltage measure. In a further example the inlet voltage drifts from 230 V rms at the beginning of the simulation to 232.3 V rms (1% in 100 s) at the end whereas all the other simulation parameters are equal to the ones of the previous example. As shown in FIG. 7 and FIG. 8, in which the results obtained with and without using the voltage information are compared, the voltage variation can be compensated only if this information is available.

As it is clear from the above description, the present invention can be used to improve the performances of an induction cooktop, to provide more information about the status of the cooking phase and to enable new product features. In particular the expected benefits are:

the estimated pot temperature can be used e.g. to monitor or control the the temperature;

the estimated food temperature can be used e.g. to monitor or control the the temperature or the cooking phase (as boil detection, boil control, in case the 'food' is 'water' or similar kind of liquids);

by knowing the type of food, the computing model is able to detect a predetermined optimal working condition, for instance the optimal temperature for the Maillard reaction (if the food is meat or the like);

the estimated food mass can be used e.g. to monitor or control the cooking phase;

the estimated coil temperature can be used e.g. to prevent damages due to overheating; and the parameters of a simplified equivalent electrical circuit that describes the behaviour of the process are useful to estimate the temperature of the pot, to detect a dynamic mismatching and the pot quality.

Even if the control method according to the present invention is primarily for applications on cooktops or the like, it can be used also in induction ovens as well.

The invention claimed is:

1. A method for controlling an induction heating system of a cooking appliance provided with an induction coil and for controlling the induction heating system in connection with a predetermined working condition, the method comprises the steps of:

measuring the value of at least one electrical parameter of the induction heating system;

feeding a computing model a value representative of an actual switching frequency signal in order to estimate a temperature indicative of a thermal status of the heating system and to provide an estimated value of the electrical parameter;

comparing the measured electrical parameter with the estimated one, wherein the electrical parameter is a current circulating in a primary circuit of the induction heating system; and tuning the computing model on the basis of such comparison, wherein the step of tuning the computing model includes the following differential equation:

$$\begin{cases} L_P\frac{di_p}{dt} + M\frac{di_s}{dt} + R_P i_p + \frac{1}{C}\int i_p(\tau)d\tau = V_{IN}(t, f) \\ M\frac{di_p}{dt} + L_s\frac{di_s}{dt} + R_s i_s = 0 \\ R_s = R_0(1 + \alpha(T_{pot} - T_0)) \end{cases}$$

where:

$C \rightarrow$ equivalent capacitance of the primary circuit;

$R_p \rightarrow$ equivalent resistance of the primary circuit;

$L_p \rightarrow$ equivalent self-inductance of the primary circuit;

$L_s \rightarrow$ equivalent self-inductance of a secondary circuit;

$M \rightarrow$ equivalent mutual inductance;

$R_s \rightarrow$ equivalent resistance of the secondary circuit;

$V_{in} \rightarrow$ input voltage of the primary circuit;

$i_p \rightarrow$ current circulating in the primary circuit;

$i_s \rightarrow$ current circulating in the secondary circuit;

$R_0 \rightarrow$ equivalent resistance of the primary circuit when $T_{pot}=T_0$;

$T_{pot} \rightarrow$ Temperature of a pot bottom $T_0 \rightarrow$ Reference temperature $\alpha \rightarrow$ A dimensional parameter.

2. The method according to claim 1, wherein the estimated temperature is related to the temperature of a cooking utensil associated to the induction heating system.

3. The method according to claim 1, wherein the estimated temperature is related to the temperature of the content of a cooking utensil placed on the induction heating system.

4. The method according to claim 3, in which a food is at least one of water or a liquid other than water, wherein the predetermined working condition is a boiling condition.

5. The method according to claim 1, wherein the computing model is adapted to detect a predetermined working condition of a predetermined food.

6. The method according to claim 1, wherein a second electrical parameter is an input voltage of the primary circuit.

7. The method according to claim 1, wherein the method further comprises a first step in which the computing model is fed with a set of predetermined electrical parameters and a second step in which the computing model is fed only with the measured electrical parameters that are affected by temperature variations.

8. Cooking appliance, comprising:

an induction heating system with an induction coil; and a control circuit, wherein the control circuit comprises:

a computing model adapted to be fed a value representative of an actual switching frequency signal, the computing model further adapted to provide an estimated temperature indicative of a thermal status of the induction heating system and an estimated value of at least one electrical parameter of the induction heating system, the control circuit being adapted to compare such estimated parameter with a measured actual one, a result of the comparison is used by the control circuit to tune the computing model, and wherein tuning the computing model includes the following differential equation:

$$\begin{cases} L_P\frac{di_p}{dt} + M\frac{di_s}{dt} + R_P i_p + \frac{1}{C}\int i_p(\tau)d\tau = V_{IN}(t, f) \\ M\frac{di_p}{dt} + L_s\frac{di_s}{dt} + R_s i_s = 0 \\ R_s = R_0(1 + \alpha(T_{pot} - T_0)) \end{cases}$$

where:

$C \rightarrow$ equivalent capacitance of the primary circuit;

$R_p \rightarrow$ equivalent resistance of the primary circuit;

$L_p \rightarrow$ equivalent self-inductance of the primary circuit;

$L_s \rightarrow$ equivalent self-inductance of the secondary circuit;

$M \rightarrow$ equivalent mutual inductance;

$R_s \rightarrow$ equivalent resistance of the secondary circuit;

$V_{in} \rightarrow$ input voltage of the primary circuit;

$i_p \rightarrow$ current circulating in the primary circuit;

$i_s \rightarrow$ current circulating in the secondary circuit;

$R_0 \rightarrow$ equivalent resistance of the primary circuit when $T_{pot}=T_0$;

$T_{pot} \rightarrow$ Temperature of the pot bottom $T_0 \rightarrow$ Reference temperature $\alpha \rightarrow$ A dimensional parameter.

* * * * *